US006953188B2

(12) United States Patent
Siegel

(10) Patent No.: US 6,953,188 B2
(45) Date of Patent: Oct. 11, 2005

(54) FLEXIBLE JAW UNIVERSAL VISE

(75) Inventor: Robert P. Siegel, Penfield, NY (US)

(73) Assignee: Rain Mountain LLC, Rochester, NY (US)

( * ) Notice: Subject to any disclaimer, the term of this patent is extended or adjusted under 35 U.S.C. 154(b) by 0 days.

(21) Appl. No.: 10/637,998

(22) Filed: Aug. 8, 2003

(65) Prior Publication Data

US 2005/0029727 A1 Feb. 10, 2005

(51) Int. Cl.[7] ..... B25B 1/20
(52) U.S. Cl. ..... 269/266; 269/254 CS
(58) Field of Search ..... 269/266, 166, 269/254 CS

(56) References Cited

U.S. PATENT DOCUMENTS

| | | | | | |
|---|---|---|---|---|---|
| 626,427 | A | | 6/1899 | Jones | |
| 1,499,989 | A | | 7/1924 | Lehmann | |
| 2,754,708 | A | * | 7/1956 | Peterson | 269/224 |
| 3,427,016 | A | * | 2/1969 | Harris | 269/214 |
| 4,187,751 | A | * | 2/1980 | Barnacle | 83/458 |
| 4,572,564 | A | * | 2/1986 | Cipolla | 294/88 |
| 4,752,063 | A | | 6/1988 | Nagy | 269/266 |
| 5,052,092 | A | * | 10/1991 | Vallauri et al. | 29/234 |
| 6,032,940 | A | | 3/2000 | Wolfe | 269/279 |
| 6,170,813 | B1 | * | 1/2001 | Bowers | 269/282 |
| D439,487 | S | | 3/2001 | Renner | D8/72 |
| 6,427,995 | B1 | * | 8/2002 | Steinwall | 269/283 |

* cited by examiner

*Primary Examiner*—Lee D. Wilson

(57) ABSTRACT

A vise used for holding and stabilizing a wide variety of work object shapes by means of conformable spring action jaw faces. The jaw faces are designed to be interchangeable to accommodate delicate or heavy-duty work. Dual ratchet mechanisms and a cam-driven piston provide both a quick and convenient method of closure that maintains precise and significant levels of clamping force. If desired, lockout features are included that defeat the spring action of the jaws and allows the vise to act more like a traditional vise. In addition, interchangeable smooth faced jaws allow the vise to function as a traditional vise.

18 Claims, 10 Drawing Sheets

10
12
14
16
18
19
20
21
22
24
25
26
27
28
29
30
31
32
33
40
41
42
43
44
45
46
51
Ratchet release 10
11
12
14
16
18
19
19
20
20
21
22
24
25
26
27
27
28
29
29
30
31
32
33
40
41
42
43
44
45
46
51

12
51
43
44
42
40
41
46
45
21
28
24
60
27
19
33
25
29
25
61
31
16
30
25
29
25
29
14
32
60
27
19
26
28
22
18

FLEXIBLE JAW UNIVERSAL VISE

BACKGROUND OF THE INVENTION

1. Field of the Invention

This disclosure relates generally to vises and, in particular, to a device that stabilizes and holds a wide variety of irregular shaped objects by means of conformable spring action jaws.

2. Background

Woodworking vises and machinist vises are very common and useful tools. Conventional vises rely on a slow and cumbersome method of closure, a non-ergonomic cranking action in a plane parallel to the body of the user. Additionally, they are limited to applications entailing work objects with two parallel sides. Certain specialized jaws are available, such as, notched jaws for holding pipes, or rubber jaws, but for the most part, specialized holding jigs must be built in order to hold irregular objects, which can take considerable time and expense. This device was invented to address both of those shortfalls, which is to say, providing a generalized and flexible holding capability, suitable for a wide range of irregular objects, while providing, a quick and ergonomic method of closure with equivalent or better mechanical advantage.

A wide variety of specialized holding and clamping devices have been developed in an attempt to accommodate irregularly shaped objects. Examples of such devices are found in U.S. Pat. Nos. 5,460,064, 5,806,385, 6,098,507, 6,092,443, and 6,138,534. While these and other devices represent and improvement in the art of holding irregularly shaped objects, they suffer from several drawbacks that have prevented widespread application in the machining arts.

U.S. Pat. No. 626,427 to E. H. Jones, issued Jun. 6, 1899 is directed to a vise in which an article is placed between two jaws provided with adjustable projections (or between a single jaw and a plane jaw) and the jaws are moved together, so that the article displaces the projections opposite to it and their ends bear on the different portions of its form and hold it up approximately as a mold would do. The projections are then clamped securely in the projections to which they have adjusted themselves and the jaw is tightened upon the article by a vise screw.

U.S. Pat. No. 1,499,989 to F. Lehmann, issued Jul. 1, 1924 discloses a vise for use with machine tools that includes a base plate adapted to be secured to the sliding carriage of a planing machine, or the like, and having two housings mounted oppositely on the base plate. The two housings are adapted such that at least one will slide toward the other and a series of spring controlled clamping jaws are so arranged in each of the housings that projecting parts of the workpiece causes part of the jaws to be pressed back into the housings until all of the spring controlled jaws are in contact with and firmly grip the workpiece on all sides.

U.S. Pat. No. 2,754,708 to C. R. Peterson, issued Jul. 17, 1956 shows a vise for handling irregular shaped object that includes a base having a stationary jaw projecting upwardly from one end and a movable jaw slidable on the base. Included in each of the jaws is a hollow block having facing openings with a plurality of movable work engaging members slidably carried in the block. A movable pressure plate in each block adjacent one side wall thereof is clampable against the work engaging members to lock each of them into work engaging position. Springs are used to urge each work-engaging member into working position.

U.S. Pat. No. 4,752,063 to Bela Nagy, issued Jun. 21, 1988 is directed to a vise attachment for use on a vise assembly for holding objects having irregularly shaped surfaces and includes a small compact housing having a plurality of blade elements disposed adjacent to each other and slidably mounted within a rectangular opening on one side of the housing and movable between and extended position and a retracted position. Each element preferably comprises a plate member having smooth planar surfaces and a concave curved back edge and stop means disposed on upper and lower edges for setting a limit for extension of the blade from the housing. A self-distributing non-resilient medium is positioned within the housing and has a predetermined volume for filing the housing when the blades are in a retracted position. A distribution and reset means causes the blades to reposition themselves to extend fully through the rectangular opening when not holding an object.

U.S. Pat. No. 6,032,940 to Ingo E. Wolfe, issued Mar. 7, 2000 discloses a universal vise that has a movable and a fixed jaw that can be indexed at 90° increments to provide for four separate work clamping surfaces on each jaw. The vise includes a vise screw driving a nut that drives the movable jaw in each of four indexed positions of the movable jaw. The indexable jaws permit the vise to be adapted to hold four different types of work pieces.

U.S. Des. Pat. No. D/439,879 to Reinhard Renner, issued Mar. 27, 2001 discloses a gripping clamp that utilizes a linear slider bar, a moveable jaw and a fixed jaw that can be tilted by means of a ratchet cam.

While the above-described vise devices are effective for their intended purpose, there is nevertheless a continuing need, and a consumer desire, for an improved vise that opens and closes quickly and easily with a high degree of mechanical advantage is usable for clamping and holding a wide variety of work object shapes.

SUMMARY OF THE INVENTION

Accordingly, a Flexi-vise is disclosed comprising a stationary and movable jaw that can be easily opened and closed primarily with a linear ratchet shaft and secondarily with a rotary ratchet cam. The jaws are designed, with each jaw having upstanding portions to accommodate a variety of interchangeable jaw faces including a jaw face containing an array of spring loaded pins. The spring-loaded pins enable the vise to grasp objects of widely varying shapes. The vise is designed to easily accommodate a variety of such jaw faces with differing force-displacement characteristics, such as, but not limited to light, medium and heavy duty, with respect to clamping force capability. Various spring-pin excursion lengths can be used to accommodate more different shapes and different spring rate characteristics. Additionally, a flat face can be installed to provide a more typical vise configuration. The linear ratchet slide mechanism that is employed allows the jaws to be brought quickly to a point where the load is engaged. Teeth on the linear ratchet ensure that the initial load on a work object is maintained. This initial load can be released by means of a spring-loaded dog attached to the movable jaw. A ratchet-loading cam is provided to significantly amplify the final clamping load by incrementally translating the movable jaw in the load direction. Teeth on this cam are finer than those on the linear ratchet. This allows the user to precisely set the holding force on a work object, one click at a time. A spring-loaded dog can be provided to release the cam load at any time. A spring-action lockout plate can also be used to defeat the spring action, which causes the vise to behave more like a rigid, traditional vise. A jaw cover and spring action lockout member is also disclosed as another means to allow the vise to function like a traditional vise.

These and other features and advantages are described in or apparent from the following detailed description of the exemplary embodiments.

BRIEF DESCRIPTION OF THE DRAWINGS

The foregoing and other features of the exemplary embodiments will be apparent and easily understood from a further reading of the specification, claims and by reference to the accompanying drawings in which like reference numerals refer to like elements and wherein:

DETAILED DESCRIPTION OF THE INVENTION

Figure 1:
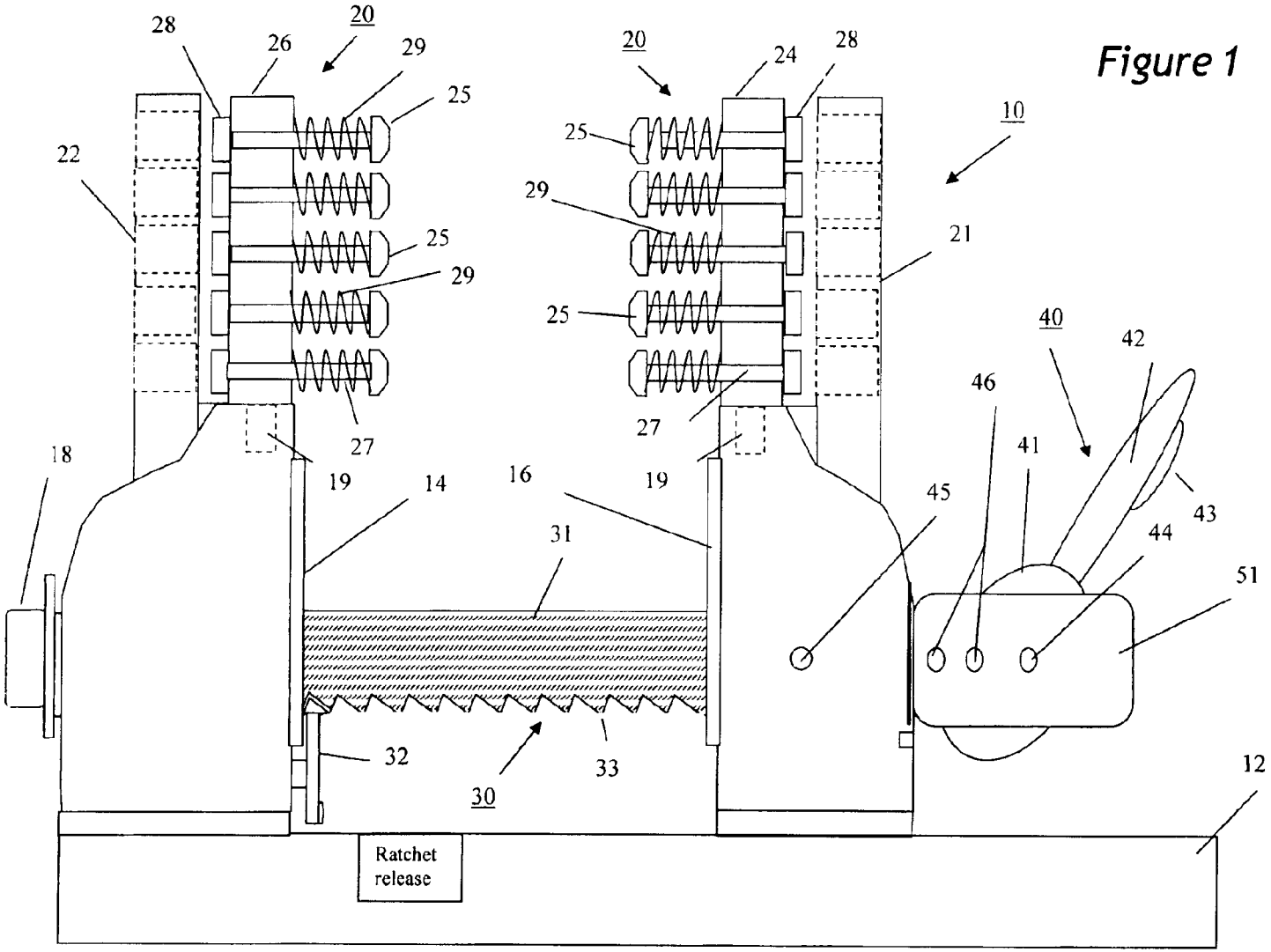
FIG. 1 is a schematic side view of a Flexi-vise apparatus.

While preferred embodiments will be described hereinafter, it will be understood that it is not intended to limit the invention to those embodiments. On the contrary, it is intended to cover all alternatives, modifications, and equivalents as may be included within the spirit and scope of the disclosure as defined by the appended claims.

For a general understanding of the features of the exemplary embodiments, reference is made to the drawings. In the drawings, like reference numerals have been used throughout to identify identical elements. FIGS. 1–10 schematically depict various views illustrating an improved vise incorporating the features of the present invention therein. It will become evident from the following discussion that the disclosed vise may be employed in a wide variety of applications for holding irregular objects and is not specifically limited in its application to the particular apparatus and method specifically mentioned herein.

Figure 2:
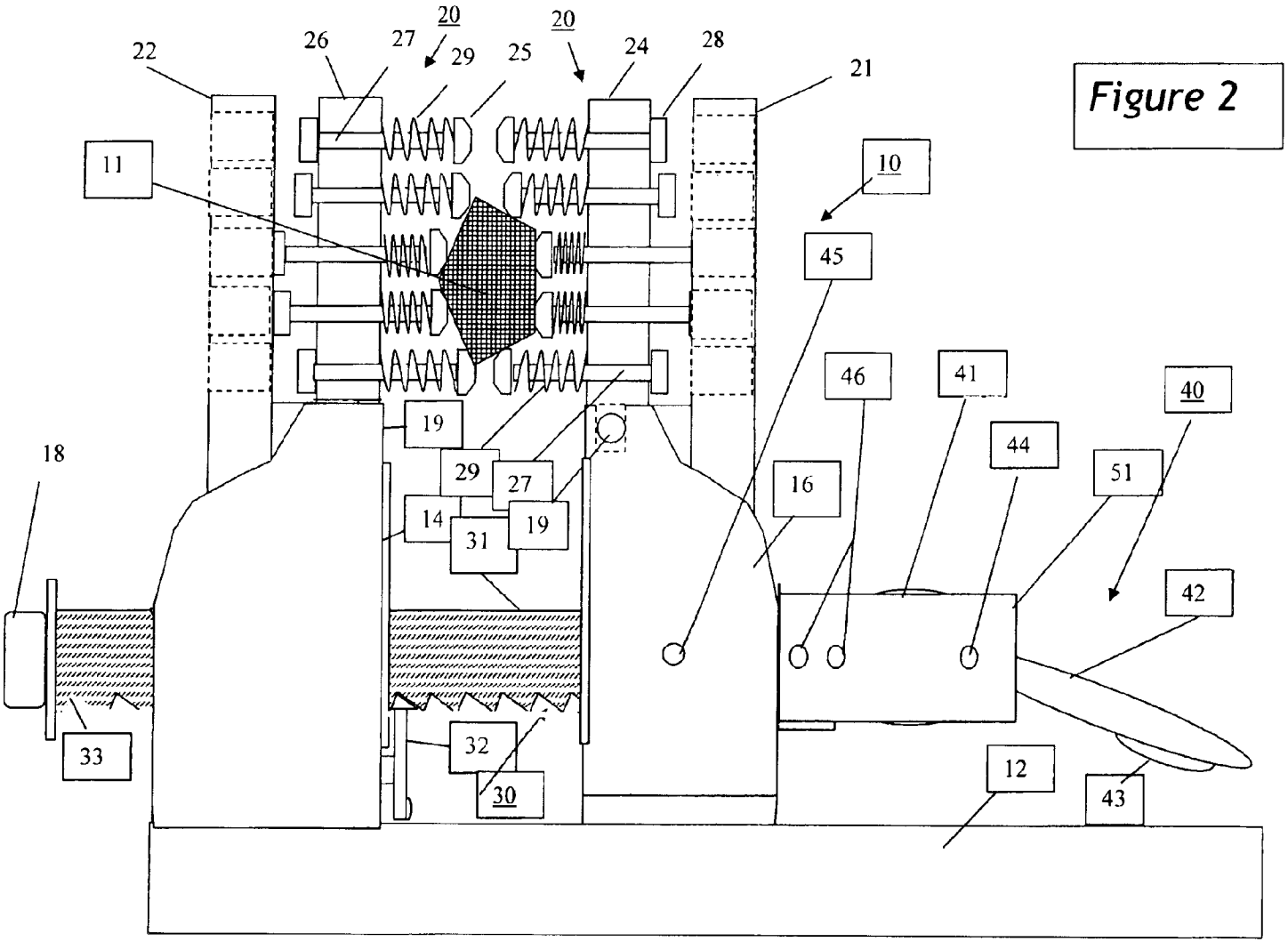
FIG. 2 is a schematic side view of the Flexi-vise of FIG. 1 showing the Flexi-vise loaded with a work piece of a non-standard shape.

Referring now to FIGS. 1–10, various views are shown illustrating the Flexi-vise 10. In FIG. 1, a base 12 supports a pair of opposing, parallel jaws 14 and 16. One jaw 14, is fixed, while the other 16, is moveable. The jaws are designed to accommodate a variety of quick-release jaw faces that can be used for a variety applications. In the preferred embodiment, a removable jaw face assembly 20 containing a dense array of spring loaded-pins 27 is installed. Each pin passes through a compression spring 29 within which it has a loose sliding fit. The pin-spring arrangement passes through clearance holes in face plate 24 in movable jaw 16 and 26 of stationary jaw 14 and is held there by an end cap 28. Upstanding extensions 21 and 22 are also provided on jaws 16 and 14 respectively, with clearance holes for the end caps 28. Flexi-vise 10 is opened and closed, by a combination of a linear ratchet mechanism 30 and a ratchet cam mechanism 40. As shown in FIG. 2, as the vise closes, pins 27 conform around a work object 11, providing an increasingly secure grasp as first, the movable jaw 16 is pushed toward stationary jaw 14 along the ratchet shaft 31, then, it is further secured by means of the ratchet cam 41 which displaces the moveable jaw 16, as a cam lever 42 is depressed. This dual action provides a secure grasp of the work object 11 by the pins 27 between the jaws.

Each pin 27 is retractable independently from the others, allowing the work object to imprint its shape into the bed of pins. This will occur on both jaws. The amount of deflection will depend on the shape of the object, the stiffness of the springs and the degree to which the jaws are closed.

A variety of jaw face assemblies can be made with various pin and spring combinations that can extend the range of Flexi-vise 10 to not only multiple shapes, but also to a broad range of holding force requirements. For example, very light springs and pins can be used to securely hold delicate objects, for light tasks, such as, painting, light assembly or adjustment. Heavier holding forces can be provided using heavier springs and pins for tasks entailing higher loads such as cutting, drilling, filing or heavy assembly. Medium duty jaw face assemblies can be used for general assembly work for complex object shapes, such as, the assembly of wire harnesses. In addition, the tips 25 of the holding pins 27 can be constructed differently for the different applications. Rubber tips might be used for the light duty version. Hard plastic tips can be used for the medium duty version and steel tips for the heavy-duty version.

It should be understood that a Flexi-vise 10 with a set of easily interchangeable jaw face assemblies is contemplated, although a single-purpose Flexi-vise could also be constructed with any one of the jaw face assemblies described above or one of a similar nature.

The length of the retractable pins will determine the degree of non-uniformity of the work object to be held, since as soon as any pin "bottoms out", the vise can close no further.

The forces on the object will be non-uniform, to the degree that the object is non-uniform. However, given the large number of pins, the distributed holding forces on the work object will generally be quite substantial. To the extent that the work object is non-uniform, pins 27 will provide lateral support only achieved in an ordinary clamping vise by means of high, and potentially destructive clamping forces.

Figure 3:
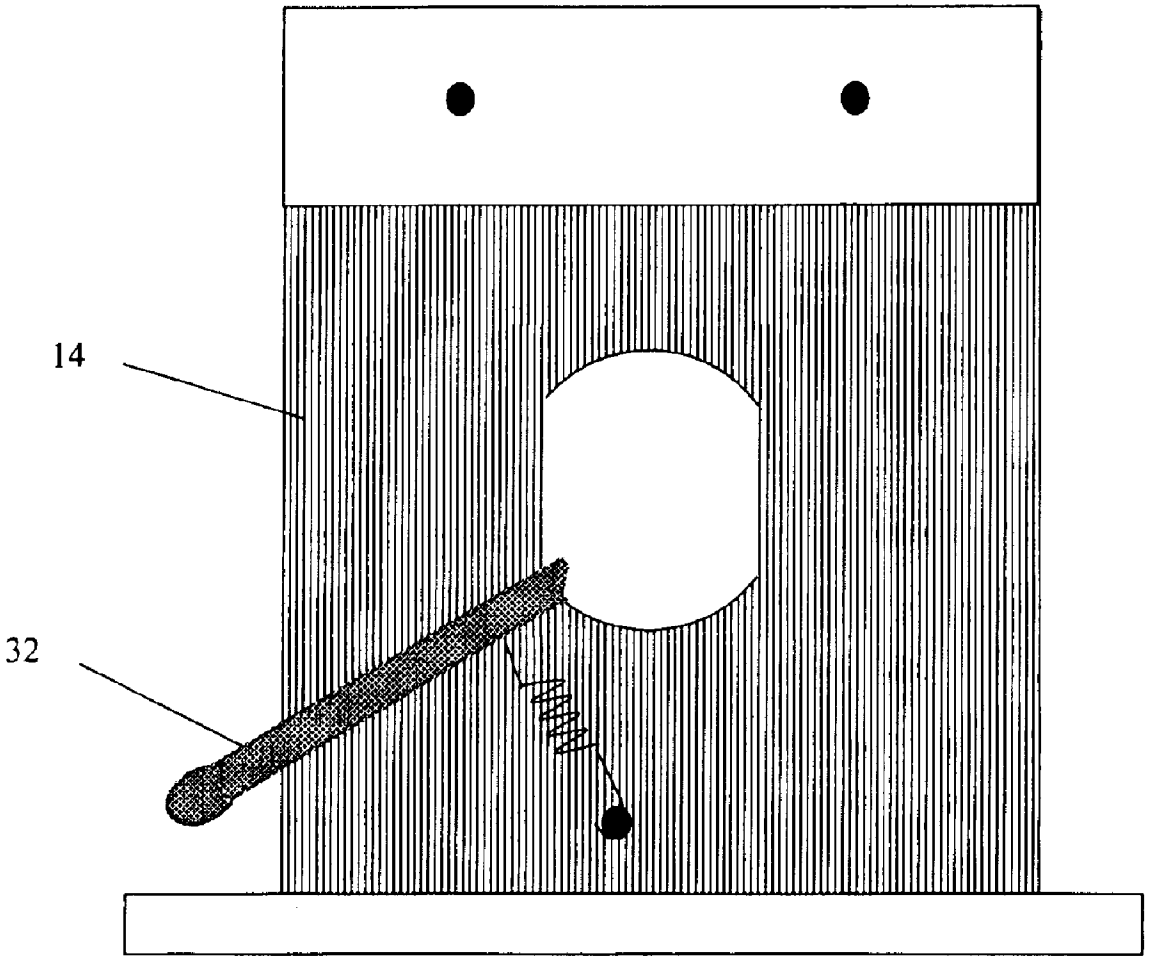
FIG. 3 is a schematic end view of the stationary jaw of the Flexi-vise shown in FIG. 1 showing the linear ratchet release mechanism.

As shown in FIGS. 1–3, Flexi-vise 10 is also unique by the means provided for opening and closing the vise. Instead of the traditional threaded shaft that is generally used to drive a vise closed, a dual ratchet system is employed. The major advantage of the threaded drive is its mechanical advantage. The disadvantage is the amount of time it can take to open or close the jaws. The required motion, which describes a circle parallel to the user's body, is also awkward. The arms can generate far more power in a plane perpendicular to the plane of the body.

In the dual ratchet system, the main drive is achieved by a linear ratchet mechanism 30 that includes the ratchet shaft 31, which takes the place of the conventional threaded drive shaft. As shown in FIGS. 1–2, shaft 31, which has approximately the same diameter as the typical vise screw, has flats on the sides to prevent rotation, and a series of parallel slots that intersperse a series of raised surfaces 33 that act as teeth. Teeth 33 have a ratchet profile, which is to say, a gentle slope in the direction that motion is being permitted (closing the jaws) and a steep profile in the direction that motion is being suppressed (opening the jaws). Movable jaw 16 is engaged on this linear ratchet shaft and moves with the shaft 31 as the entire linear ratchet mechanism 30 is slid forward. A spring-loaded dog 32, shown in FIG. 3 mounted on fixed jaw 14, is used to engage teeth 33, thus avoiding back slip as the jaws begin to engage the load. This is necessary, since the spring-loaded jaws will present a resisting force once the load is engaged. This drive action is significantly faster than a traditional vise, though it lacks the mechanical advantage of the traditional screw drive. The ratchet cam mechanism 40 of the dual ratchet mechanisms includes a rotary ratchet cam 41 that more than compensates for this. The ratchet cam 41 has a limited throw (typically less than one inch depending on the specific cam profile). It is intended to be deployed after the movable jaw 16, riding on the linear ratchet shaft 31 has engaged work piece 11 and it either closes to the final load point, or, as far as the user is able to push it shut against the resisting force of the springs 29. However far Flexi-vise 10 is closed at this point, it will remain closed by virtue of linear ratchet 31, and spring-loaded dog 32 engaging the ratchet teeth 33. Once deployed, the ratchet cam 41, also remains loaded by virtue of the ratchet dog 52 interacting with ratchet teeth on the inner surface of the ratchet cam mounting plates 51 as shown in FIG. 5.

Figure 4:
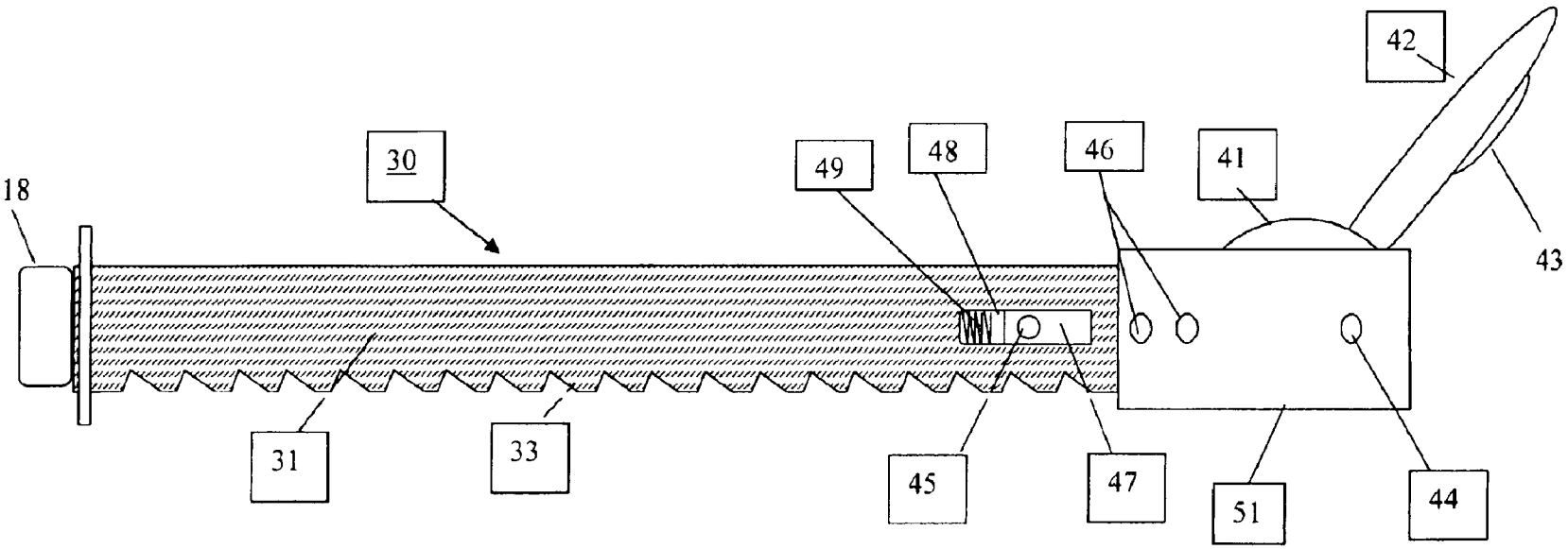
FIG. 4 is a schematic side view of the linear ratchet bar assembly shown in FIGS. 1 and 2.
Figure 5:
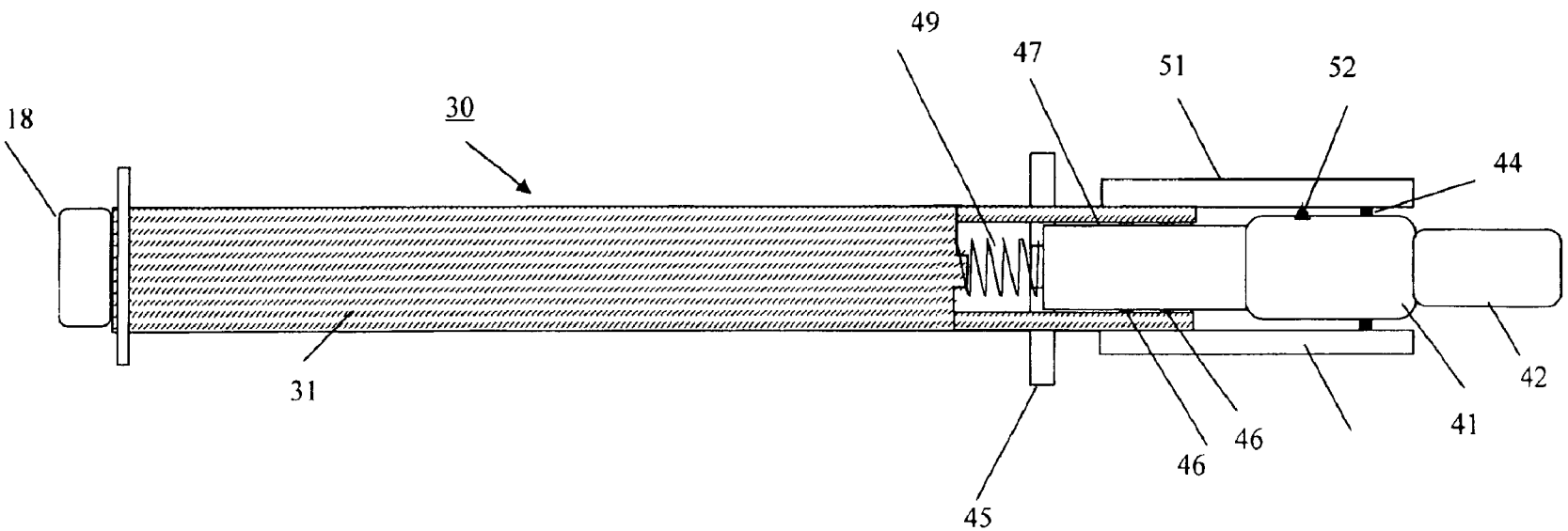
FIG. 5 is a schematic plan view of the linear ratchet bar assembly shown in FIGS. 1 and 2.
Figure 6:
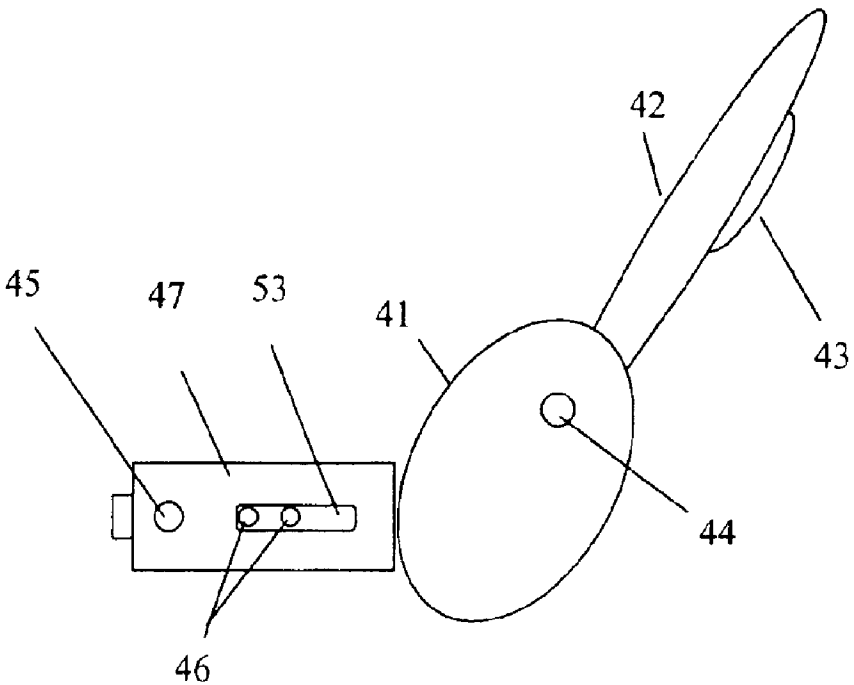
FIG. 6 is a side view detail of the ratchet cam and piston arrangement.

FIGS. 4–6 show the details of the dual cam system. The movable jaw 16 is pinned to a piston 47 that rides inside ratchet shaft 31 by means of the drive pin 45. The drive pin 45 passes through a slot 48 in the ratchet shaft rather than a hole. This allows the movable jaw to translate with respect to the shaft, a distance that is comparable to the linear "throw" of the ratchet cam 41, and independently of the linear ratchet shaft position, This is important since it does not disturb that "locked" state achieved by the linear ratchet mechanism. The ratchet cam 41 sits inside a cutout in linear ratchet shaft 31. A compression spring 49 maintains a biasing force against the piston 47.

The ratchet cam 41, can be deployed by manipulating cam lever 42 to increase the loading of the jaws by means of a cam action with a mechanical advantage, exceeding that of a traditional screw drive. Ratchet cam 41, which has a finer click-stop ratchet action than the linear ratchet slide 30, provides for a very precise administration of clamping force.

The ratchet cam mechanism 40 utilizes a rotary ratchet mechanism, to capture and hold any forward progress made by the user as a clamping force is exerted with cam lever 42. The ratchet action is produced by the interaction of retractable ratchet tooth 52 located on one or both of the side faces of ratchet cam 41, and a grooved inner surface of the cam mounting plates 51. The ratchet cam mechanism 40 is oriented in a vertical plane so that the user can put body weight into it as cam lever 42 is pressed down. Cam pivot shaft 44 is affixed to the linear ratchet shaft 31 by means of the two cam mounting plates 51. The cam 41, when rotated, pushes against the piston 47, which slides inside the ratchet shaft 31. The piston 47 drives the moveable jaw 16 forward by means of the drive pin 45, which is free to move forward through the slot 48 in the ratchet shaft. There is also a slot 53 in the piston 47 that retains it and aligns it to the ratchet shaft 31 by means of the two piston engagement pins 46. The slot 53 allows it to slide forward in response to the cam 41 action. The cam ratchet release button 43, located under the cam lever 42, retracts the cam ratchet tooth 52, to allow the ratchet cam 41 to release.

As shown in FIG. 6, The slot 53 in the piston 47 is used to capture and align it with respect to the ratchet shaft 31.

Figures 7A, 7B:
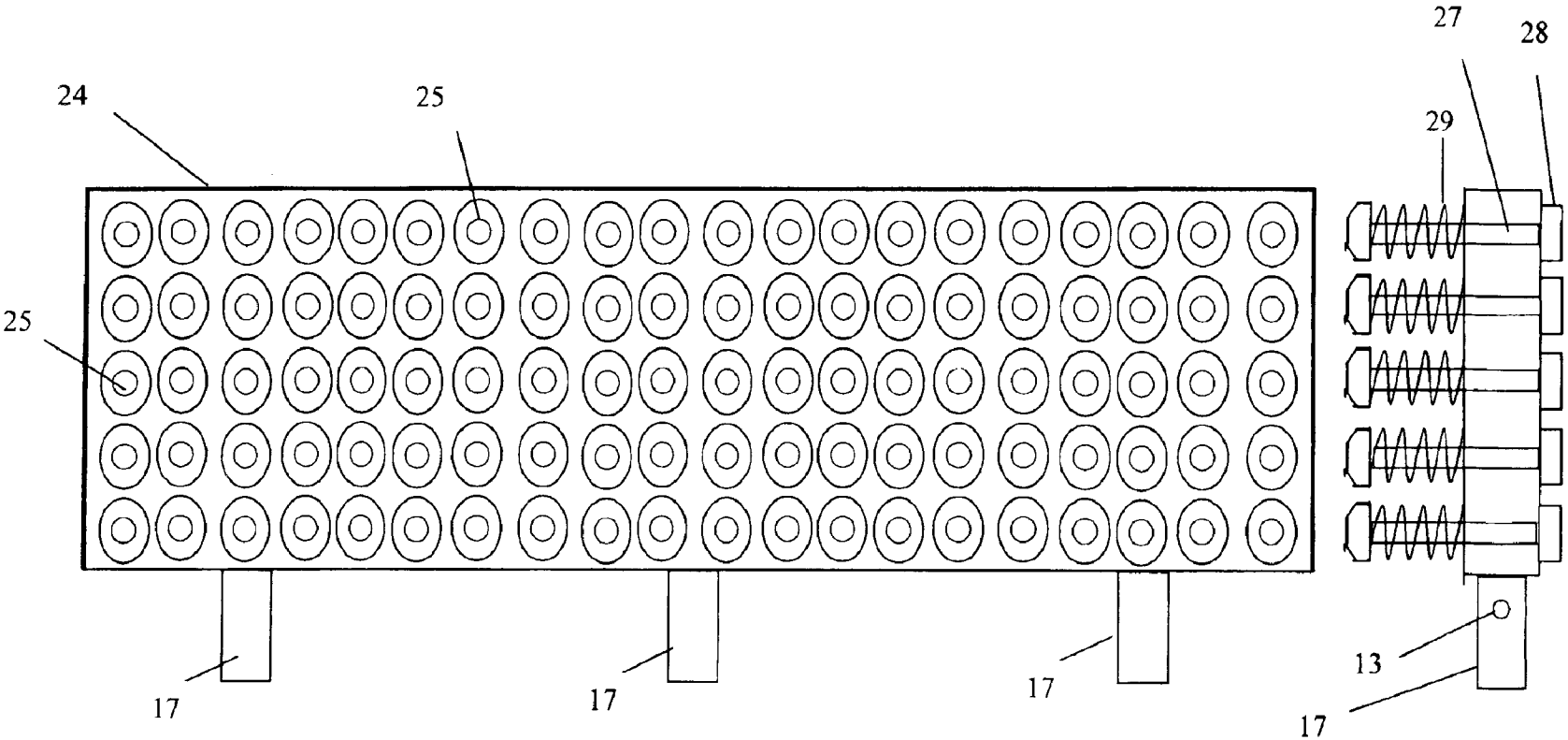
FIG. 7A is a front view of a typical spring-loaded pin array jaw face of the Flexi-vise of FIG. 1 showing the loading pin ends and the quick-release mounting pins.
FIG. 7B is a side view of the spring-loaded pin array jaw face shown in FIG. 7A.

FIGS. 7A and 7B show the front and side views, respectively, of spring-loaded jaw face 24. In these views, pins 17 that are used to mount the jaw face onto moveable jaw 16 can be seen.

Figures 8A, 8B:
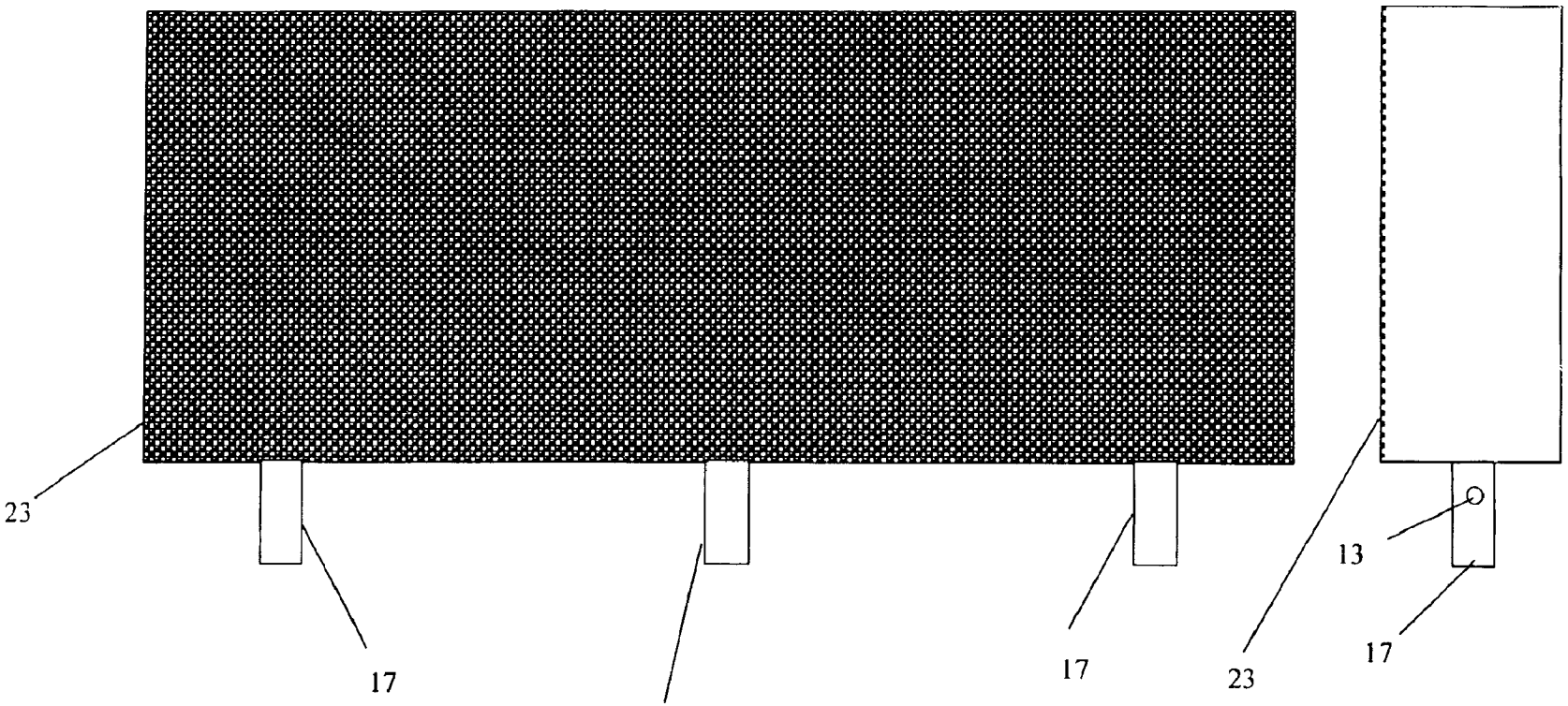
FIG. 8A is a front view of a flat jaw face of the Flexi-vise of FIG. 1 showing the quick release mounting pins.
FIG. 8B is a side view of the flat jaw face of FIG. 8.

FIGS. 8A and 8B show front and side views, respectively, of an optional flat jaw face 23, which essentially gives this vise the same capability as a traditional vise.

A hole 13 can be seen in each of the mounting pins 17 of FIGS. 7B and 8B. These holes accommodate jaw face engagement pins 19 as shown in FIG. 1, that secure the quick-release jaws while in operation.

Figure 9:
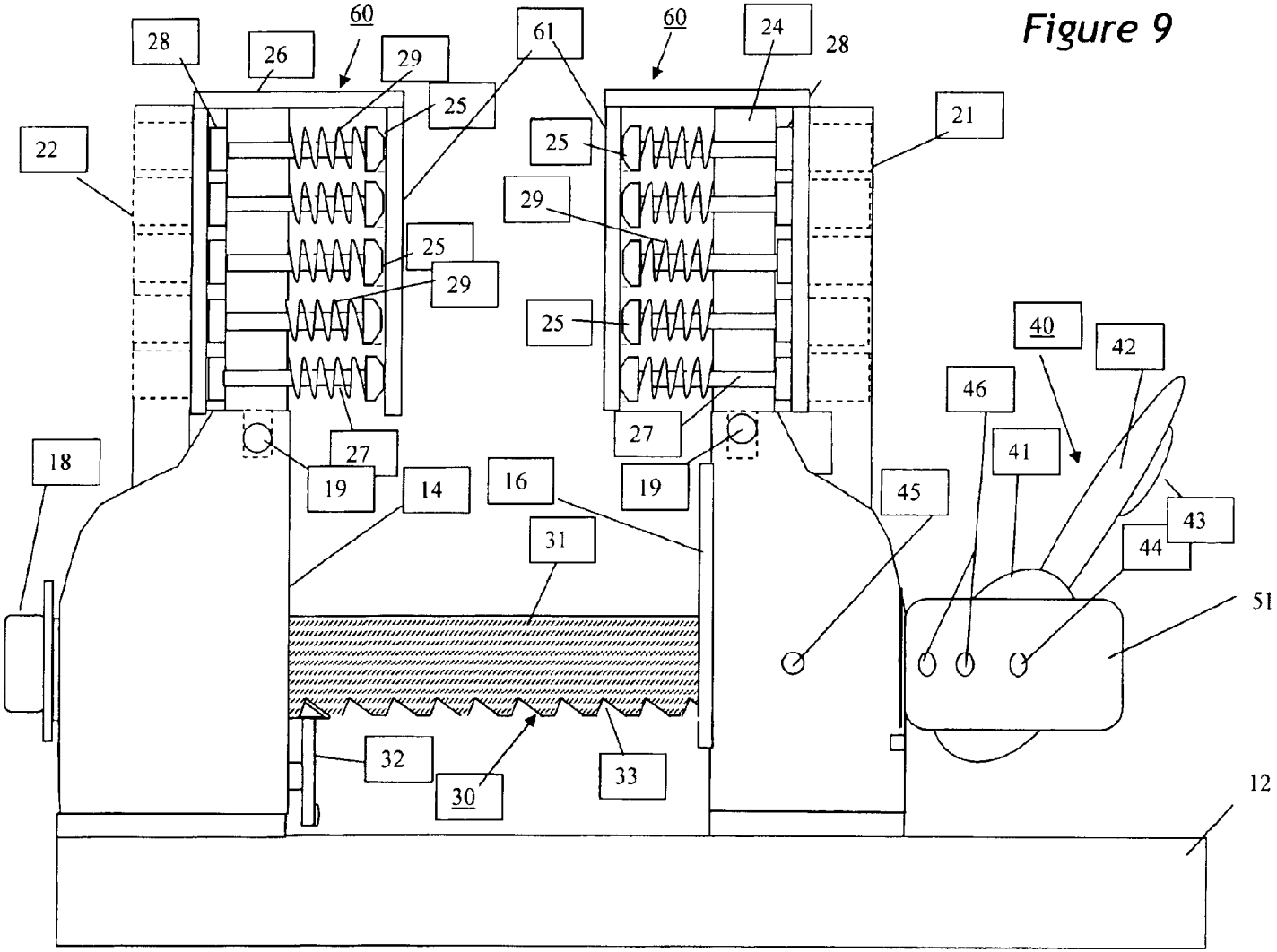
FIG. 9 is a schematic side view of the Flexi-vise of FIG. 1 showing a standard vise conversion feature.

An accessory is shown in FIG. 9 for Flexi-vise 10 that can change the behavior of the vise, to more in keeping with that of a traditional vise. In FIG. 9, a "U" shaped jaw face cover 60 made of a material, such as, sheet metal, is shown inserted between upstanding members 20, 22 and 24, 26 of jaws 16 and 14, respectively, and in front of the pin heads 25. The jaw cover is located in the slot formed by the back of the spring-pin array of the jaw face assembly 20 in its unloaded position and the Jaw upstanding members 21 and 22 that have an array of holes therein which align with the spring-pin array and are large enough to accommodate the pin end caps 28. These holes allow the spring-pin end caps to pass through under conditions of ordinary operation. However, the spacing between upstanding members 21, 22, 24 and 26 provides a slot into which the back end of jaw cover 60 can be placed to provide a spring-action lock-out feature. With jaw cover 60 in place, the spring pins 27 cannot move, thus providing a rigid jaw, more like that of a standard vise, as well as, provide a pair of smooth, parallel faces 61 when placed over upstanding members 24 and 26. This essentially emulates a traditional vise, allowing this tool, in many cases, to become a full replacement of a traditional vise.

Figure 10:
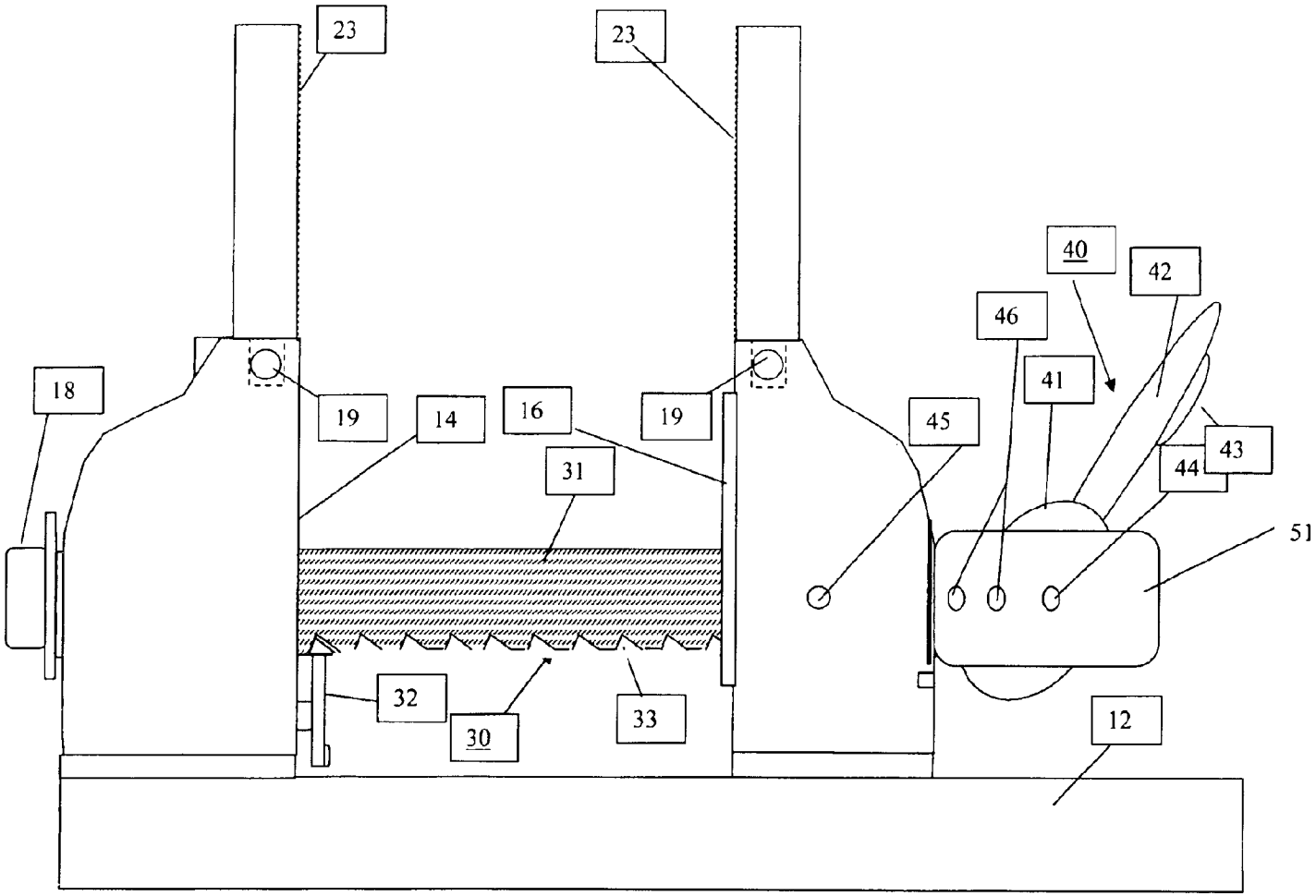
FIG. 10 is a schematic view of the Flexi-vise of FIG. 1 with the flat jaw face of FIG. 8 installed in each jaw.

In FIG. 10, a Flexi-vise configuration is shown utilizing the flat jaw face 23 of FIG. 8A. This is another way of providing behavior equivalent to a traditional vise jaw. No additional upstanding members are required in this case.

In recapitulation, a Flexi-vise having a unique means of rapidly and conveniently closing vise jaws to grasp and secure an object that utilizes a linear ratchet shaft, a secondary securing step utilizing a ratchet cam to provide, a very powerful clamping action, a flexible system of quick release jaw face assemblies including one with spring loaded pins, capable of accommodating a variety of application-specific requirements. The spring-loaded pins enable the vise to grasp objects of widely varying shapes. The vise can accommodate a variety of jaws with differing force-displacement characteristics, such as, but not limited to light, medium and heavy duty, with respect to clamping force capability. Various spring-pin excursion lengths can also be provided, to accommodate more different shapes and different spring rate characteristics. Flat face jaws can also be used. A simple arrangement such as a set of tight fitting pins with a cross-locking engagement pin can be used to mount the jaws. A linear ratchet slide mechanism is employed that allows the jaws to be brought quickly to a point where the load is engaged. The ratchet teeth ensure that the initial load on the object is maintained. This initial load can be released by means of a spring-loaded dog attached to the movable jaw. A ratchet-loading cam is provided to significantly amplify the final clamping load. The teeth on this cam are finer than those on the linear ratchet. This allows the user to precisely set the holding force on a work object, one click at a time. A spring-loaded dog is provided to release the cam load at any time. A selectable spring-action lockout jaw cover feature is included which defeats the spring action, causing the vise to behave exactly like a traditional vise.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A vise, comprising:

a base member;

a stationary jaw and a movable jaw projecting upwardly from and slidable on said base;

a linear ratchet slide mechanism connecting said stationary jaw to said movable jaw, said linear ratchet slide mechanism being adapted to allow quick movement of said movable jaw towards said stationary jaw to a point where a work object is engaged; and a ratchet cam arrangement wherein said ratchet cam comprises a lever with a cam which engages a piston within said linear ratchet slide mechanism thereby displacing said movable jaw towards said fixed jaw.

2. The vise of claim 1, wherein said ratchet cam arrangement includes teeth that are finer than teeth contained in said linear ratchet slide mechanism.

3. The vise of claim 2, including spring loaded dogs to release the load placed on the work object by said linear ratchet slide mechanism and said ratchet cam arrangement.

4. The vise of claim 3, wherein each of said jaws contains a jaw face assembly with an array of spring loaded pins that allow the jaws to grasp work objects of a wide variety of sizes and shapes.

5. The vise of claim 4, wherein each of said stationary and movable jaws include spaced upstanding portions.

6. The vise of claim 5, wherein said linear ratchet slide mechanism includes a ratchet shaft with a slot to allow the movable jaw to incrementally slide relative to said ratchet shaft.

7. The vise of claim 5, including a U-shaped cover member having a first portion thereof adapted to be placed between each of said upstanding members of said stationary and movable jaws to thereby defeat the spring action of said spring loaded pins and a second portion thereof adapted to be placed over said spring loaded pins in order to present a smooth traditional vise surface to a work object.

8. The vise of claim 7, wherein said cover member is made of sheet metal.

9. The vise of claim 1, wherein said ratchet cam arrangement includes a cam and a cam lever, and wherein said cam is oriented in a vertical plane so that a user's full weight can be applied to said cam lever.

10. The vise of claim 1, wherein said stationary and movable jaws have interchangeable jaw face assemblies that accommodate multiple shapes of work objects and provide a broad range of holding forces.

11. Multi-purpose vise, comprising:

a base member;

a stationary jaw and a movable jaw projecting upwardly from and slidable on said base, said stationary and movable jaws including detachable jaw face assemblies;

a linear ratchet slide mechanism connecting said stationary jaw to said movable jaw, said linear ratchet slide mechanism being adapted to allow quick movement of said movable jaw towards said stationary jaw to a point where a work object is engaged; and a ratchet cam arrangement wherein said ratchet cam comprises a lever with a cam which engages a piston within said linear ratchet slide mechanism thereby displacing said movable jaw towards said fixed jaw.

12. The multi-purpose vise of claim 11, wherein each of said detachable jaw face assemblies contain an array of spring loaded pins that allow the jaws to grasp work objects of a wide variety of sizes and shapes.

13. The multi-purpose vise of claim 12, including a U-shaped cover member having a portion thereof adapted to be placed over said spring loaded pins in order to defeat the spring action of said spring loaded pins and present a smooth traditional vise surface to a work object.

14. The multi-purpose vise of claim 11, wherein each of said jaws contain a detachable smooth face.

15. The multi-purpose vise of claim 11, wherein said ratchet cam arrangement includes teeth that are finer than teeth contained in said linear ratchet slide mechanism.

16. The multi-purpose vise of claim 11, wherein said ratchet cam arrangement includes a cam and a cam lever, and wherein said cam is oriented in a vertical plane so that a user's full weight can be applied to said cam lever.

17. A vise, comprising:

a base member;

a stationary jaw and a movable jaw projecting upwardly from and slidable on said base, said stationary and movable jaws each of said containing a removable jaw face assembly with an array of spring loaded pins that allow the jaws to grasp work objects of a wide variety of sizes and shapes;

a linear ratchet slide mechanism connecting said stationary jaw to said movable jaw, said linear ratchet slide mechanism being adapted to allow quick movement of said movable jaw towards said stationary jaw to a point where a work object is engaged; and a ratchet cam arrangement wherein said ratchet cam comprises a lever with a cam which engages a piston within said linear ratchet slide mechanism thereby displacing said movable jaw towards said fixed jaw.

18. The vise of claim 17, including a U-shaped cover member having a portion thereof adapted to be placed over said spring loaded pins in order to defeat the spring action of said spring loaded pins and present a smooth traditional vise surface to a work object.

* * * * *